US005221157A

United States Patent [19]

Prestedge

[11] Patent Number: 5,221,157

[45] Date of Patent: Jun. 22, 1993

[54] REVETMENTS AND UNITS FOR USE IN CONSTRUCTING REVETMENTS

[76] Inventor: Gordon K. Prestedge, P.O. Box 523, Stellenbósch, 7600, South Africa

[21] Appl. No.: 815,335

[22] Filed: Dec. 27, 1991

[51] Int. Cl.[5] ..... E07D 29/02

[52] U.S. Cl. ..... 405/16; 405/31; 405/35; 405/284

[58] Field of Search ..... 405/16, 17, 30, 31, 405/33, 34, 35, 262, 284

[56] References Cited

U.S. PATENT DOCUMENTS 3,282,054 11/1966 Sagihor ..... 405/262
4,718,792 1/1988 Louis ..... 405/262

FOREIGN PATENT DOCUMENTS 893644 4/1944 France ..... 405/286
923509 1/1947 France ..... 405/284
968989 12/1950 France ..... 405/16
9924 1/1980 Japan ..... 405/16
1485004 9/1977 United Kingdom ..... 405/284

*Primary Examiner*—David H. Corbin
*Assistant Examiner*—Arlen L. Olsen
*Attorney, Agent, or Firm*—Ladas & Parry

[57] ABSTRACT

Revetments are constructed using a plurality of revetment units which are arranged on river bed or the like. Each revetment unit comprises a stem and a disc-like head. The stem is stepped so that it has a relatively short larger diameter part and a relatively long smaller diameter part. The heads of units in each upper course lie behind the heads of the units in the course below and rest on the larger diameter parts. The heads and stems are preferably circular in cross-section but can be multi-facetted.

12 Claims, 3 Drawing Sheets

REVETMENTS AND UNITS FOR USE IN CONSTRUCTING REVETMENTS

FIELD OF THE INVENTION

THIS INVENTION relates to revetments and to units for use in constructing revetments.

BACKGROUND OF THE INVENTION

Sea walls, river and canal banks, harbour walls and walls surrounding marinas are revetments which pose technical problems not found in dry land embankments e.g. highway embankments and other civil engineering works. "Wet" revetments are subject to the scouring action of flowing water and to direct wave action which can result in severe forces being imposed. Additionally, when constructing a "wet" revetment, the conditions can be difficult. For example the bed on which the revetment must be built can be uneven and levelling it may be an impossible task. Hence, the choice in certain circumstances of broken rock which drops into the crevices and serves to level the bed. Furthermore it may not be possible to use cofferdams to hold back the water and enable building to take place in relatively dry conditions. In these circumstances the lower part of the revetment may have to be constructed underwater. If the water is turbid the first part of the construction must be done "blind" unless the circumstances are such that divers can be used.

"Wet" revetments comprising broken rock, concrete and stone blocks and cast in situ walls are all in common use.

One specific form of revetment block is disclosed in U.S. Pat. No. 3,282,054. This block has a main body portion which is rectangular and a protrusion of T-shape extending from the rear of the body portion. The blocks are arranged in courses. The body portions form the face of the embankment and each body portion rests on the protrusions of the blocks below. The protrusions are buried in the material which forms the embankment. Such a unit can only successfully be used where there is a flat base onto which the lower course is placed. If there is only an uneven base then the block cannot be used successfully. The ability to build horizontal courses is a prerequisite to the successful use of this block. Hence it has no function in underwater work where a rough bed must be built on.

OBJECTS OF THE INVENTION

An object of the present invention is to provide an improved revetment unit which can be used to build a revetment on an uneven bed.

Another object of the present invention is to provide a revetment unit which can be placed onto revetment units which are already in situ and which will automatically nest with other units.

Another object of the present invention is to provide an improved revetment which is constructed from a plurality of revetment units.

BRIEF SUMMARY OF THE INVENTION

According to one aspect of the present invention there is provided a revetment comprising a plurality of groups of three revetment units one of which units is at a higher level than the other two, each unit comprising a head having a front face, a rear face and a peripheral edge, and a stem protruding from said rear face, the peripheral edge of said one unit resting on the stems of the two units below it at two contact zones, the portion of said edge of said one unit which extends from one of said zones to the other being between said stems of said two units.

Said heads and said stems are preferably circular in cross-section. The stem of each unit can be stepped so that it has a relatively short larger diameter part adjacent said head and a relatively long smaller diameter part protruding from the larger diameter part, said edge of said one unit resting on said relatively short larger diameter parts of said two units.

According to a further aspect of the present invention there is provided a revetment unit comprising a disc-like head having a front face, a rear face and a peripheral edge, and a stem protruding from said rear face, the stem being centrally located with respect to the head and said peripheral face being smoothly curved throughout its circumferential extent.

In this form said peripheral edge is preferably circular, but could be oval, and said stem is preferably circular in cross-section. Furthermore, said stem can be stepped and have a relatively short larger diameter part adjacent said head and a relatively long smaller diameter part protruding from the larger diameter part.

According to another aspect of the present invention there is provided a revetment unit comprising a head having a front face, a rear face and a peripheral edge, and a stem protruding from said rear face, the stem being centrally located with respect to said head and said peripheral edge being multi-facetted and comprising a least five faces.

Said edge is preferably composed of between five and eight faces. In this form the cross-sectional shape of said stem can be identical to the cross-sectional shape of said head. Furthermore the stem can be stepped and have a relatively short larger diameter part adjacent said head and a relatively long smaller diameter part protruding from the larger diameter part, said parts each being identical in cross-sectional shape to said head and to one another.

According to yet another aspect of the present invention there is provided a revetment unit which comprises a head having a front face, a rear face and a stem protruding from said rear face, the stem being centrally located with respect to said head and said unit being symmetrical about the common longitudinal axis of said head and stem.

BRIEF DESCRIPTION OF THE INVENTION

For a better understanding of the present invention, and to show how the same may be carried into effect, reference will now be made, by way of example, to the accompanying drawings in which:

FIG. 1 is a side elevation of a first form of revetment unit in accordance with the present invention, FIG. 2 is a side view of a second form of revetment unit in accordance with the present invention, FIG. 3 is a view taken in the direction of arrow III in FIG. 2, FIG. 4 is a diagrammatic elevation showing a typical revetment constructed from the units of FIGS. 2 and 3, FIG. 5 is a front view of a slightly modified form of the revetment shown in FIG. 4, FIGS. 6 and 7 are front views of two further revetment units.

DETAILED DESCRIPTION OF THE INVENTION

Figure 1:
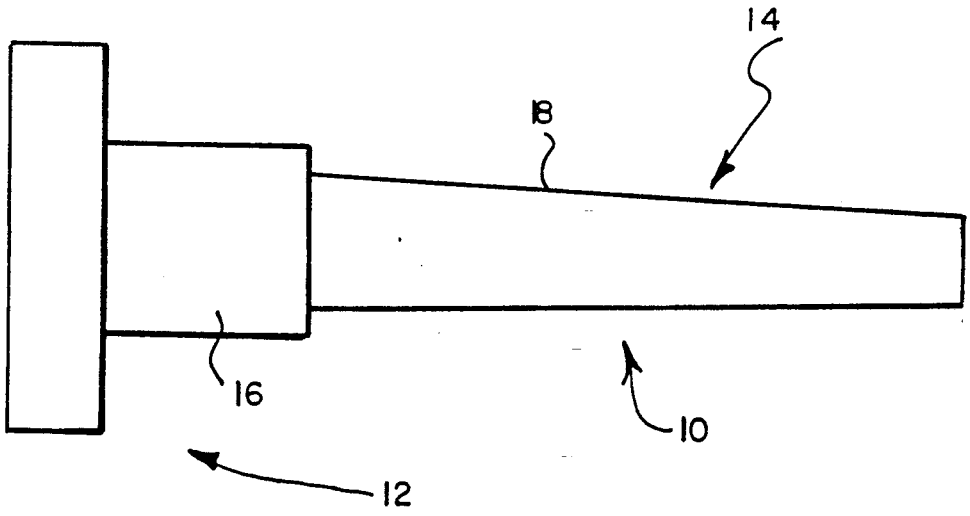

Referring firstly to FIG. 1, the revetment unit illustrated is generally designated 10 and includes a head 12 and a stem 14. The head 12 is disc like and has a front face, a rear face and a peripheral edge. The stem 14 protrudes from the rear face of the head 12 and is stepped so as to provide a relatively short larger diameter part 16 adjacent the head and relatively long smaller diameter part 18 protruding from the larger diameter part 16. The part 18 tapers from the cylindrical portion 16 towards the free end thereof.

Figure 2:
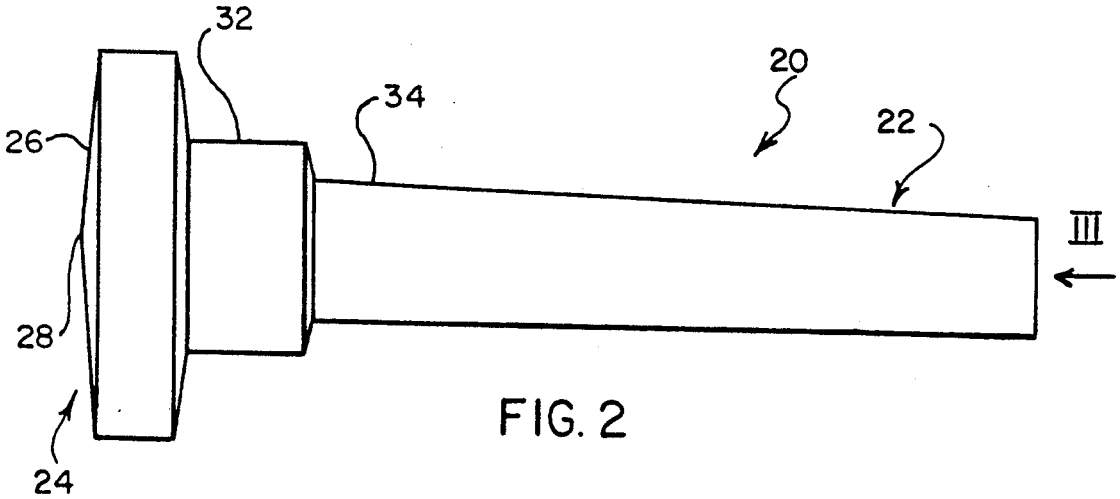
Figure 3:
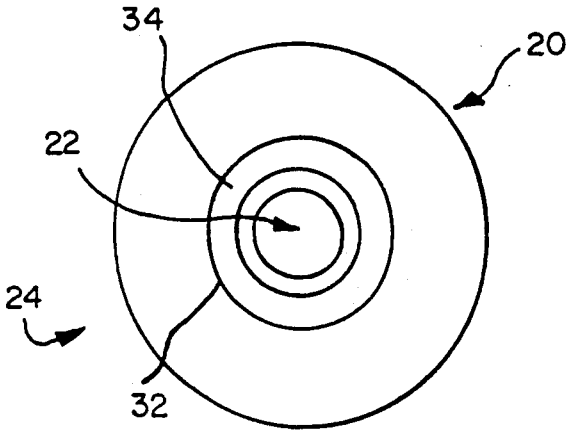

The revetment unit 20 of FIGS. 2 and 3 is similar to the revetment unit of FIG. 1 and comprises a stem 22 and a head 24. The head 24 is again disc-like. The face 26 of the head is not flat as is the face of the head of FIG. 1 but is somewhat conical in form having an apex designated 28. The other face of the disc is also slightly conical. The two parts of the stem 22 are designated 32 and 34. The part 34 tapers.

Figure 4:
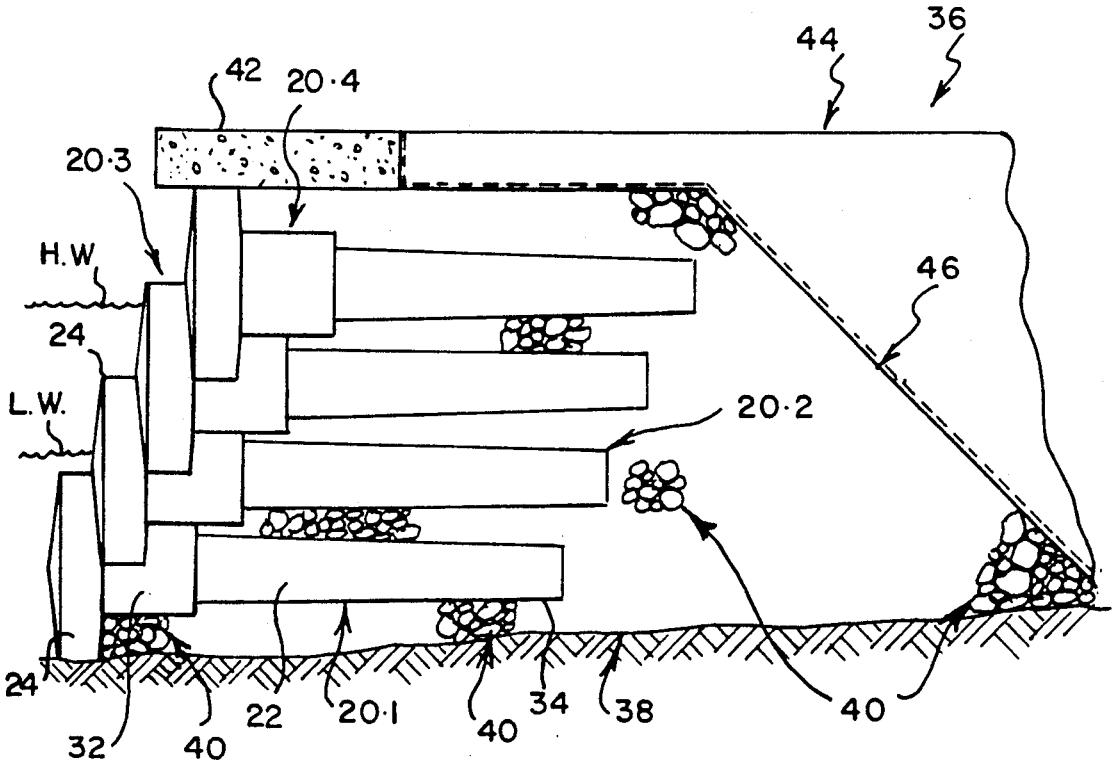
Figure 5:
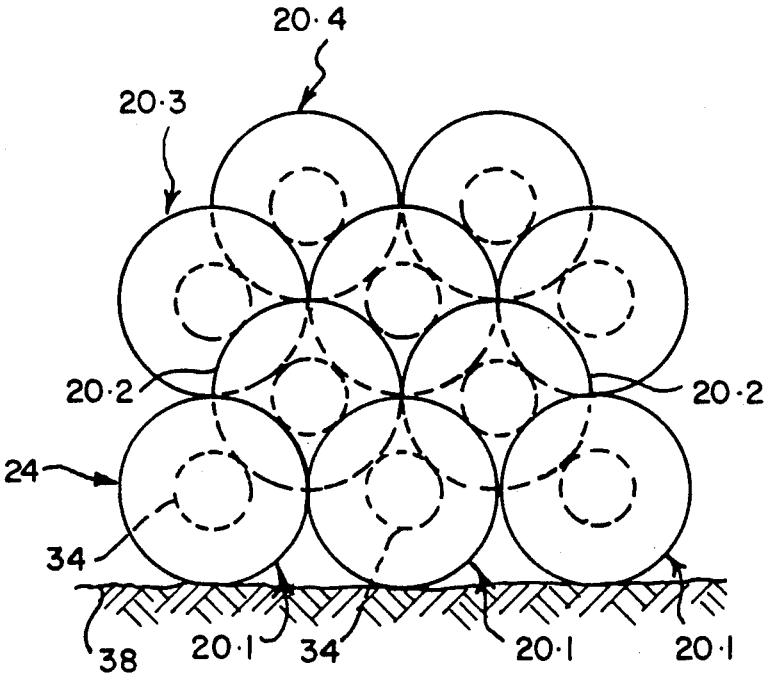

Turning now to FIGS. 4 and 5, these Figures show a number of revetment units 20 in use to stabilize a revetment which is generally designated 36. Merely by way of example the wall is shown as being a sea wall, high water and low water levels being designated HW and LW respectively in FIG. 4.

Reference numeral 38 designates the base on which the revetment 36 is built. The base 38 can be sand or rock. A lower layer of rubble designated 40 is dumped on the base 38 to build-up the level. A first horizontal layer of revetment units, designated 20.1, is then placed on the layer of rubble. The peripheries of the heads 24 touch one another (see particularly FIG. 5). The parts 32 and 34 overly the layer of rubble 40 with the heads 24 adjacent the seaward face of the layer of rubble and resting on the base 38. Further rubble is then dumped on the stems of the layer of units 20.1 and then a second layer of units 20.2 is placed on the layer 20.1. The heads 24 of the units 20.2 drop down behind the head 24 of the lower layer of units 20.1. In the form shown in FIG. 4 the head 24 rest on the stem parts 32 of the lower layer of units 20.1. In the form shown in FIG. 5 the stem parts 32 are omitted and each stem consists entirely of the part 34.

The units 20.2 are thus restrained from seaward and sideways movement of the lower layer 20.1. Rubble behind the units prevents their rearward movement. Further layers of rubble and further layers of units 20.3 and 20.4 build the revetment to the desired level. A cast in-situ capping 42 supported on the heads 24 of the layer of revetment units 20.4, and compacted backfill 44, complete the wall. Before the backfill is dumped and compacted, a filter layer 46 is placed on the rubble 40.

Using the revetment units described it is possible to build a wall which has a relatively steep front face. It can therefore be used as a jetty for mooring boats. It is also capable of withstanding wave action as the individual units interlock with one another and each resists movement of the neighbouring revetment units under wave action.

Whilst revetment units which have disc-like heads which are circular in elevation, and stems which are circular in cross-section are preferred, such a configuration is not essential. It is preferred because, as another unit is lowered onto those already in place, it readily rolls into the nesting configuration illustrated in FIG. 5. Multi-facetted heads and stems are also possible, the greater the number of facets the greater the ease with which the unit moves into place. Heads and stems with five or more facets are possible, heads and stems with eight facets being preferred if for any reason it is desired to diverge from a circular section.

Figure 6:
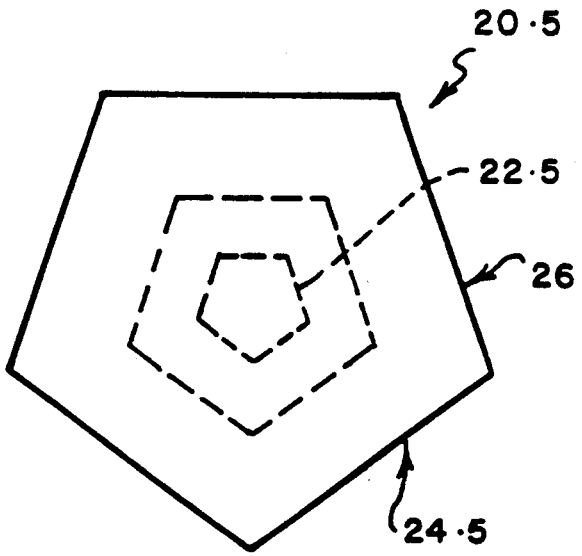
Figure 7:
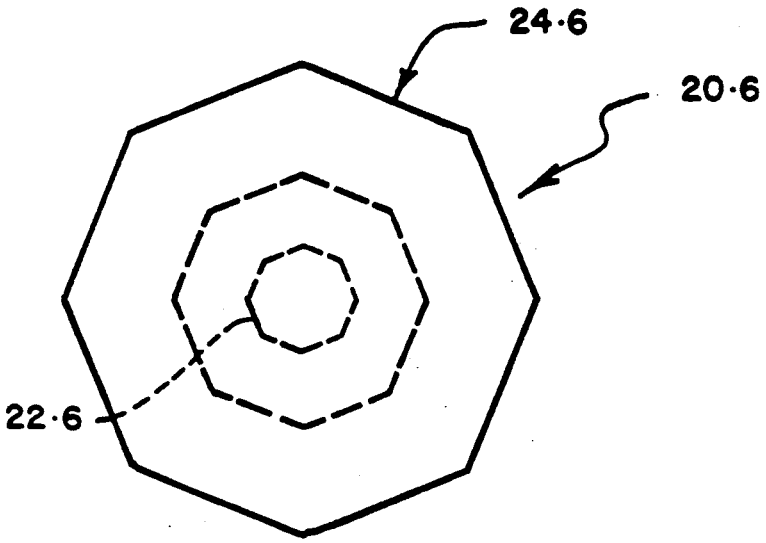

FIGS. 6 and 7 show revetment units 20.5 and 20.6 with five and eight facets respectively. The stems 22.5 and 22.6 of the units shown in FIGS. 6 and 7 are of the same cross-sectional shape as the heads 24.5 and 24.6 of those units. It is also possible for the edge of the head to be smoothly curved without being circular. For example, it may be oval. The shape must not, however, diverge too far from circular.

I claim:

1. A revetment comprising a plurality of groups of three revetment units one of which units is at a higher level than the other two, each unit comprising a head having a front face, a rear face and a peripheral edge, and a stem protruding from said rear face, the peripheral edge of said one unit resting on the stems of the two units below it at two contact zones with a portion of the peripheral edge of said one unit extending from one of said zones to the other, said peripheral edge being shaped such that the portion of said edge of said one unit which extends from one of said zones to the other protrudes downwardly below a plane defined by an upper periphery of said stems and between the stems of said two units.

2. A revetment according to claim 1 in which said heads and said stems are circular in cross-section.

3. A revetment according to claim 2 in which the stem of each unit is stepped and has a relatively short larger diameter part adjacent said head and a relatively long smaller diameter part protruding from the larger diameter part, said edge of said one unit resting on said relatively short larger diameter parts of said two units.

4. A revetment according to claim 1 in which said peripheral edge of each unit is smoothly curved throughout its circumferential extent.

5. A revetment according to claim 4 in which said peripheral edge of each unit is circular.

6. A revetment according to claim 5, in which said stem of each unit is circular in cross-section.

7. A revetment according to claim 6 in which said stem of each unit is stepped and has a relatively short larger diameter part adjacent said head and a relatively long smaller diameter part protruding from the larger diameter part.

8. A revetment according to claim 1, in which said peripheral edge of each unit is multi-facetted and comprises at least five faces.

9. A revetment according to claim 8 in which said peripheral edge of each unit is composed of between five and eight faces.

10. A revetment according to claim 9 in which the cross-sectional shape of the stem of each unit is identical to the cross-sectional shape of the head of each unit.

11. A revetment according to claim 10 in which said stem of each unit is stepped, and has a relatively short larger diameter part adjacent said head and a relatively long smaller diameter part protruding from the larger diameter part, said parts each being identical in cross-sectional shape to said head and to one another.

12. A revetment according to claim 1 in which said stem of each unit is centrally located with respect to the head of that unit and said unit is symmetrical about the common longitudinal axis of said head and stem.

* * * * *